US008207914B2

(12) United States Patent
Cok et al.

(10) Patent No.: US 8,207,914 B2
(45) Date of Patent: Jun. 26, 2012

(54) OLED DISPLAY WITH AGING COMPENSATION

(75) Inventors: Ronald S. Cok, Rochester, NY (US); Felipe A. Leon, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 591 days.

(21) Appl. No.: 11/268,253

(22) Filed: Nov. 7, 2005

(65) Prior Publication Data

US 2007/0103411 A1 May 10, 2007

(51) Int. Cl.
*G09G 3/32* (2006.01)

(52) U.S. Cl. ..... 345/76; 345/82; 345/204; 345/77; 315/169.3

(58) Field of Classification Search ..... 345/76, 345/82, 77, 204; 315/169.3
See application file for complete search history.

(56) References Cited

U.S. PATENT DOCUMENTS

| | | | | |
|---|---|---|---|---|
| 6,414,661 | B1 * | 7/2002 | Shen et al. | 345/82 |
| 6,441,560 | B1 * | 8/2002 | Hunter | 315/169.1 |
| 6,504,565 | B1 | 1/2003 | Narita et al. | |
| 7,012,626 | B2 * | 3/2006 | Shingai et al. | 345/690 |
| 7,262,753 | B2 * | 8/2007 | Tanghe et al. | 345/82 |
| 2002/0101395 | A1 * | 8/2002 | Inukai | 345/83 |
| 2004/0150590 | A1 | 8/2004 | Cok et al. | |
| 2004/0212573 | A1 * | 10/2004 | Sundahl et al. | 345/82 |
| 2005/0110786 | A1 * | 5/2005 | Inoue et al. | 345/210 |
| 2005/0179628 | A1 * | 8/2005 | Kimura | 345/77 |
| 2006/0139278 | A1 * | 6/2006 | Shingai et al. | 345/92 |

FOREIGN PATENT DOCUMENTS

JP 2002-278514 9/2002

* cited by examiner

*Primary Examiner* — Amare Mengistu
*Assistant Examiner* — Joseph G Rodriguez
(74) *Attorney, Agent, or Firm* — Morgan, Lewis & Bockius LLP

(57) ABSTRACT

A method of compensating image signals for driving an OLED display having a plurality of light-emitting elements having outputs that change with time or use, comprising the steps of: a) obtaining a measured or estimated first value of the current used by individual light-emitting elements in response to known image signals at a first time; b) specifying multiple groups of light-emitting elements at a second time, wherein at least one of the specified groups contains at least one light-emitting element common to another specified group; c) measuring total currents used by each of the specified groups in response to known image signals at a second time; d) forming an estimated second value of the current used by individual light-emitting elements based on the measured total currents, e) calculating correction values for individual light-emitting elements based on the difference between the first and second current values, and f) employing the correction values to compensate image signals for the changes in the output of the light-emitting elements and produce compensated image signals.

19 Claims, 10 Drawing Sheets

OLED DISPLAY WITH AGING COMPENSATION

FIELD OF THE INVENTION

The present invention relates to solid-state OLED flat-panel display devices and more particularly to such display devices having means to compensate for the aging of the organic light-emitting display.

BACKGROUND OF THE INVENTION

Solid-state organic light-emitting diode (OLED) image display devices are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the device age and become less efficient at emitting light. This reduces the lifetime of the display. The differing organic materials may age at different rates, causing differential color aging and a display whose white point varies as the display is used. If some light-emitting elements in the display are used more than other, spatially differentiated aging may result, causing portions of the display to be dimmer than other portions when driven with a similar signal.

Referring to FIG. 2, a graph illustrating the typical light output of an OLED display device as current is passed through the OLEDs is shown. The three curves represent typical performance of the different light emitters emitting differently colored light (e.g. red, green and blue light emitters, respectively) as represented by luminance output over time or cumulative current. As can be seen by the curves, the decay in luminance between the differently colored light emitters can be different. The differences can be due to different aging characteristics of materials used in the differently colored light emitters, or due to different usages of the differently colored light emitters. Hence, in conventional use, with no aging correction, the display will become less bright and the color, in particular the white point, of the display will shift.

The rate at which light-emitting elements in OLED displays age is related to the amount of current that passes through the device and, hence, the amount of light that has been emitted from the display. U.S. Pat. No. 6,414,661 B1 issued Jul. 2, 2002 to Shen et al. describes a method and associated system that compensates for long-term variations in the light-emitting efficiency of individual organic light-emitting diodes (OLEDs) in an OLED display device, by calculating and predicting the decay in light output efficiency of each pixel based on the accumulated drive current applied to the pixel and derives a correction coefficient that is applied to the next drive current for each pixel. This technique requires the measurement and accumulation of drive current applied to each pixel, requiring a stored memory that must be continuously updated as the display is used, requiring complex and extensive circuitry.

U.S. Pat. No. 6,504,565 B1 issued Jan. 7, 2003 to Narita et al., describes a light-emitting device which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant. An exposure device employing the light-emitting device, and an image forming apparatus employing the exposure device are also disclosed. This design also requires pixel usage accumulation and the use of a calculation unit responsive to usage information for each pixel, greatly increasing the complexity of the circuit design.

JP 2002278514 A by Numeo Koji, published Sep. 27, 2002, describes a method in which a prescribed voltage is applied to organic EL elements by a current-measuring circuit and the current flows are measured; and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics and the temperature at the time of the characteristics measurements for estimating the current-luminance characteristics of the elements. Then, the total sum of the amount of currents being supplied to the elements in the interval during which display data are displayed, is changed so as to obtain the luminance that is to be originally displayed, based on the estimated values of the current-luminance characteristics, the values of the current flowing in the elements, and the display data. This design presumes a predictable relative use of pixels and does not accommodate differences in actual usage of groups of pixels or of individual pixels. Hence, correction for color or spatial groups is likely to be inaccurate over time.

US2004/0150590 entitled "OLED Display with Aging Compensation" by Cok et al describes an OLED display that includes a plurality of light-emitting elements divided into two or more groups, the light-emitting elements having an output that changes with time or use; a current measuring device for sensing the total current used by the display to produce a current signal; and a controller for simultaneously activating all of the light-emitting elements in a group and responsive to the current signal for calculating a correction signal for the light-emitting elements in the group and applying the correction signal to input image signals to produce corrected input image signals that compensate for the changes in the output of the light-emitting elements of the group. While it is suggested that each group may consist of an individual light-emitting element, the current measurement of individual light-emitting elements is time-consuming and may be difficult and inaccurate because the current through each element is typically very small. Alternatively, OLED systems that employ independent measurements of distinct groups of light-emitting elements over the entire OLED device are limited in their ability to deal with differential usage or light-emitter performance of individual elements within each group and cannot effectively compensate for such differential aging. Accordingly, it would be desirable to provide an aging compensation system wherein the speed and accuracy with which the current usage of individual light emitting elements may be measured is improved.

SUMMARY OF THE INVENTION

In accordance with one embodiment, a method of compensating image signals for driving an OLED display having a plurality of light-emitting elements having outputs that change with time or use is described, comprising the steps of:

a) obtaining a measured or estimated first value of the current used by individual light-emitting elements in response to known image signals at a first time;

b) specifying multiple groups of light-emitting elements at a second time, wherein at least one of the specified groups contains at least one light-emitting element common to another specified group;

c) measuring total currents used by each of the specified groups in response to known image signals at a second time;

d) forming an estimated second value of the current used by individual light-emitting elements based on the measured total currents;

e) calculating correction values for individual light-emitting elements based on the difference between the first and second current values; and f) employing the correction values to compensate image signals for the changes in the output of the light-emitting elements and produce compensated image signals.

Advantages

The advantages of this invention include providing an OLED display device that compensates for the aging of the organic materials in the display without requiring extensive or complex circuitry, and having improved accuracy and/or speed of measurement.

DETAILED DESCRIPTION OF THE INVENTION

Figure 1:
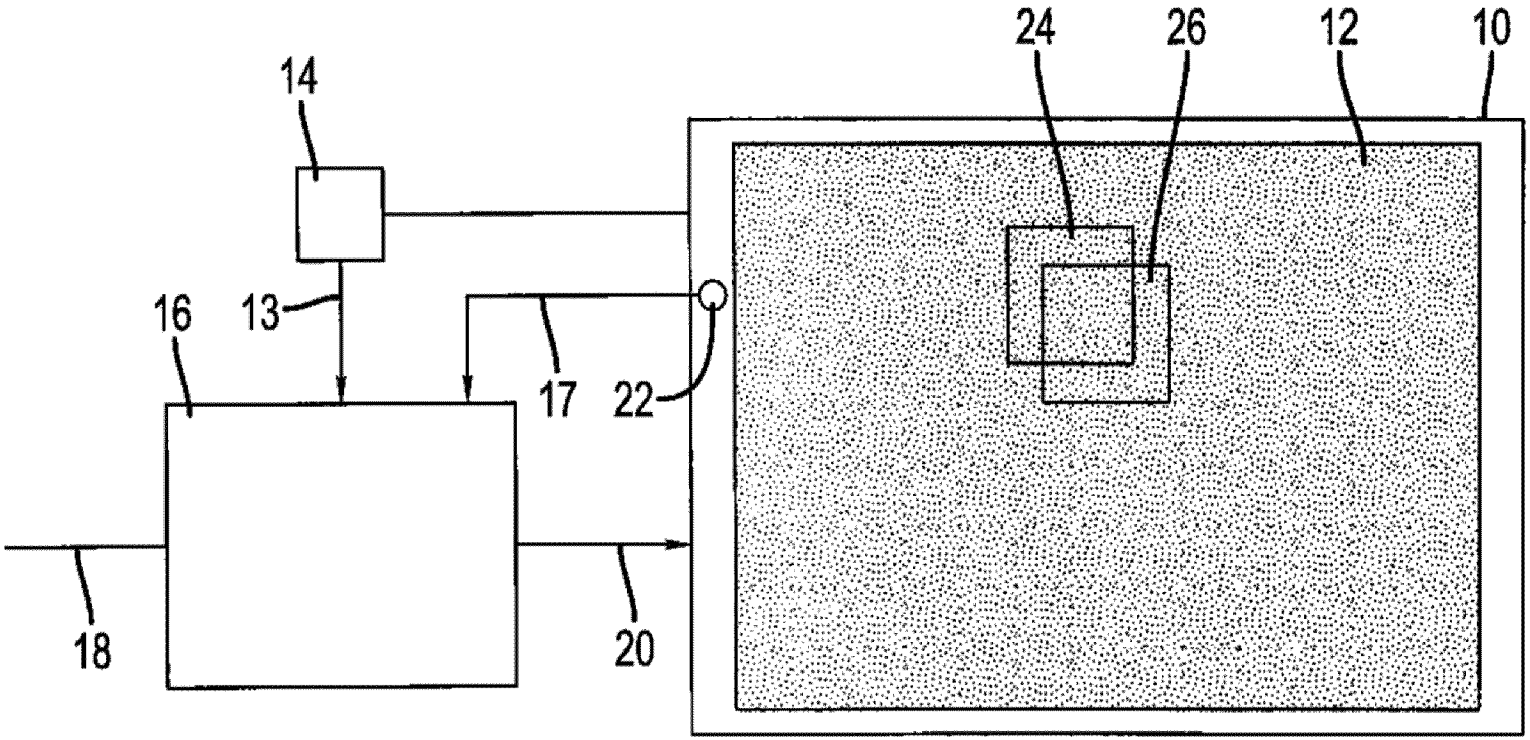
FIG. 1 is a schematic diagram of an OLED display with feedback and control circuits according to an embodiment of the present invention.

Referring to FIG. 1, an OLED display 10 system comprises a plurality of light-emitting elements 12 having outputs that change with time or use divided into two or more specified groups 24 and 26 wherein at least one light-emitting element is common to both groups 24 and 26. A current measuring device 14 senses the total current used by the display 10 at any given time when driven by a known image signal that causes the display 10 to illuminate the light-emitting elements 12 in one of the groups 24 or 26 to produce a total current signal 13. In a display calibration mode, controller 16 provides known image signals that activate all of the light-emitting elements 12 in each group 24 and 26. The controller 16 forms estimated values of current used by individual light-emitting elements in response to the total current signals 13, and stores at least one estimate of current used. By specifying groups containing at least one light-emitting element common to another specified group, improved accuracy and/or speed of current measurement may be obtained as further described below. The controller 16 also calculates a correction value for the light-emitting elements 12 in each group 24 and 26 based on a comparison between the instant estimated values of current used and prior estimated or measured values of current, and applies the correction value to image signals 18 during display operation to produce compensated image signals 20 that compensate for the changes in the output of the light-emitting elements 12 of each group 24 and 26.

Initial prior estimated or measured values of individual light-emitting element current usage may be formed, e.g., during manufacture, after manufacture and prior to product shipment, or by display users before putting the display into operation. In a particular embodiment, the measured or estimated first value of the current used by individual light-emitting may be obtained by specifying first multiple groups of light-emitting elements at a first time, measuring first total currents used by each of the first groups in response to known image signals at the first time, and forming a first estimated value of the current used by individual light-emitting elements based on the measured first total currents. In such embodiment, the estimated second value of the current used by individual light-emitting is obtained by specifying second multiple groups of light-emitting elements at the second time, wherein at least one of the specified second groups contains at least one light-emitting element common to another specified second group, measuring second total currents used by each of the second groups in response to known image signals at the second time, and forming the estimated second value of the current used by individual light-emitting elements based on the measured second total currents. The first and second multiple groups may, but need not be, equivalently specified.

OLED devices and displays comprising a plurality of individual light-emitting elements are known in the art, as are controllers for driving OLEDs, performing calculations, and correcting image signals, for example by employing look-up tables or matrix transforms. The current measuring device 14 can comprise, for example, a resistor connected across the terminals of an operational amplifier as is known in the art.

In one embodiment, the display 10 is a color image display comprising an array of pixels, each pixel including a plurality of differently colored light-emitting elements 12 (e.g. red, green, and blue) that are individually controlled by the controller circuit 16 to display a color image. The colored light-emitting elements may be formed by different organic light-emitting materials that emit light of different colors, alternatively, they may all be formed by the same organic white light-emitting materials with color filters over the individual elements to produce the different colors. In another embodiment, the light-emitting elements are individual graphic elements within a display and may not be organized as an array. In either embodiment, the light-emitting elements may have either passive- or active-matrix control and may either have a bottom-emitting or top-emitting architecture.

The aging of the OLEDs is related to the cumulative current passed through the OLED resulting in reduced performance, also the aging of the OLED material results in an increase in the apparent resistance of the OLED that causes a decrease in the current passing through the OLED at a given driving voltage. The decrease in current is directly related to the decrease in luminance of the OLED at a given driving voltage. In addition to the OLED resistance changing with use, the light-emitting efficiency of the organic materials is reduced. The aging and brightness of the OLED materials is also related to the temperature of the OLED device and materials when current passes through them. Hence, in a further embodiment of the present invention, a temperature sensor 22 providing a temperature signal 17 may be constructed on or adjacent to the OLED display 10 and the controller 16 may also be responsive to the temperature signal 17 to calculate the correction value or perform measurements only when the device is within a pre-determined temperature range.

A model of the luminance decrease and its relationship to the decrease in current at a given driving voltage may be generated by driving an OLED display with a known image signal and measuring the change in current and luminance over time. A correction value for the known image signal necessary to cause the OLED display to output a nominal luminance for a given input image signal may then be determined for each type of OLED material in the OLED display 10. The correction value is then employed to calculate a compensated image signal. Thus, by controlling the signal applied to the OLED, an OLED display with a constant luminance and white point may be achieved and localized aging corrected.

The present invention provides a means to effectively balance the competing demands of accuracy in measurement with speed of measurement. Typically, there are very many light-emitting elements within an OLED display and individual elements require only very small amounts of current (e.g. picoAmps) that are difficult to measure. By employing groups of light-emitting elements that are turned on together, the current used is larger and the measurements may be easier and more accurate. At the same time, fewer measurements may be necessary. However, the accuracy of the estimates for current used by each light-emitting element is compromised. By specifying multiple groups of light-emitting elements wherein specified groups contain at least one light-emitting element common to another specified group, the accuracy of the estimates may be improved by combining the various current measurements of each specified group within which an individual light-emitting element is included, and deriving the individual light-emitting element current usage from the combination of measurements.

Figure 3A:
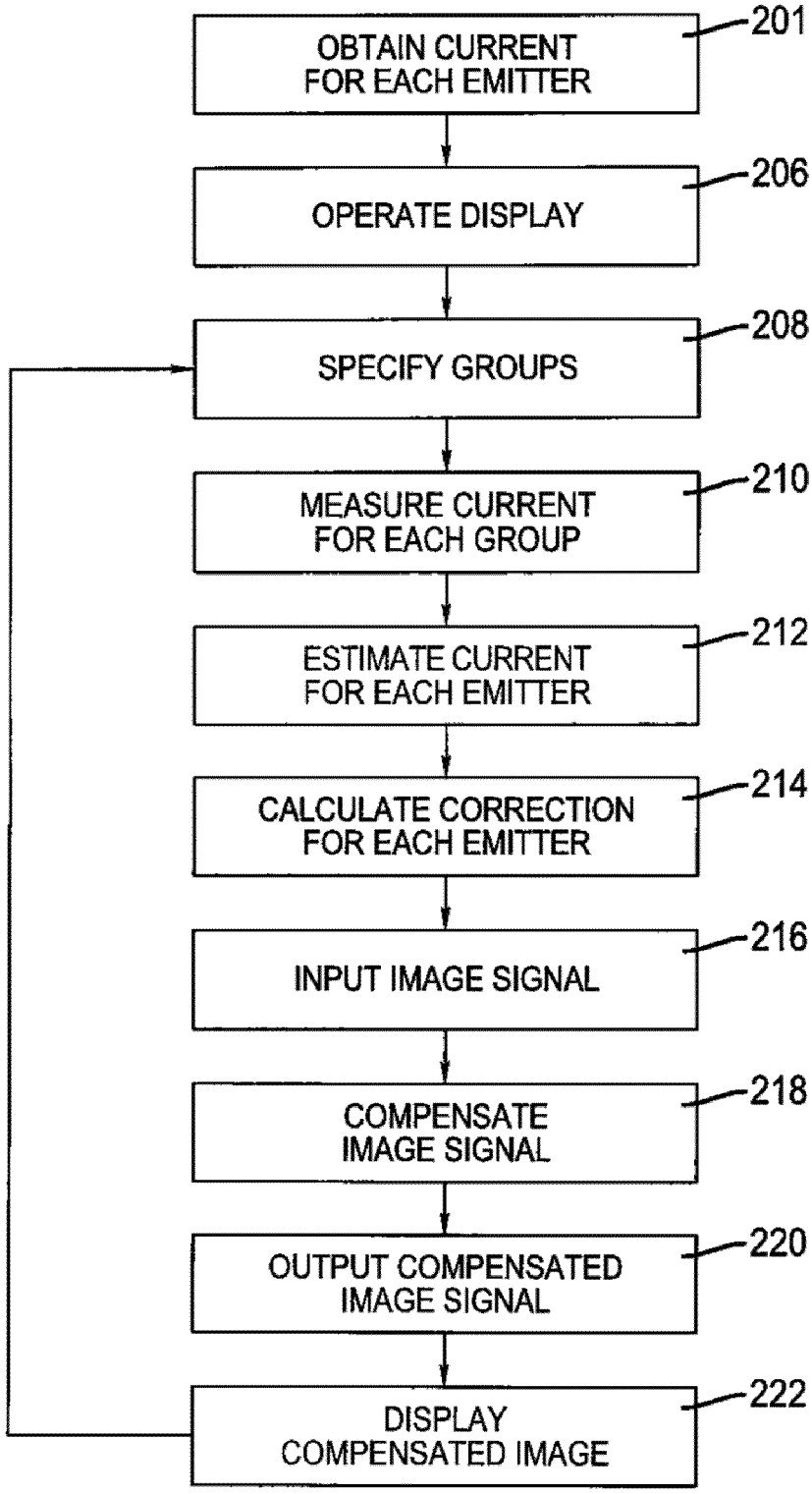
FIGS. 3*a* and 3*b* are flowcharts illustrating embodiments of the present invention.
Figure 3B:
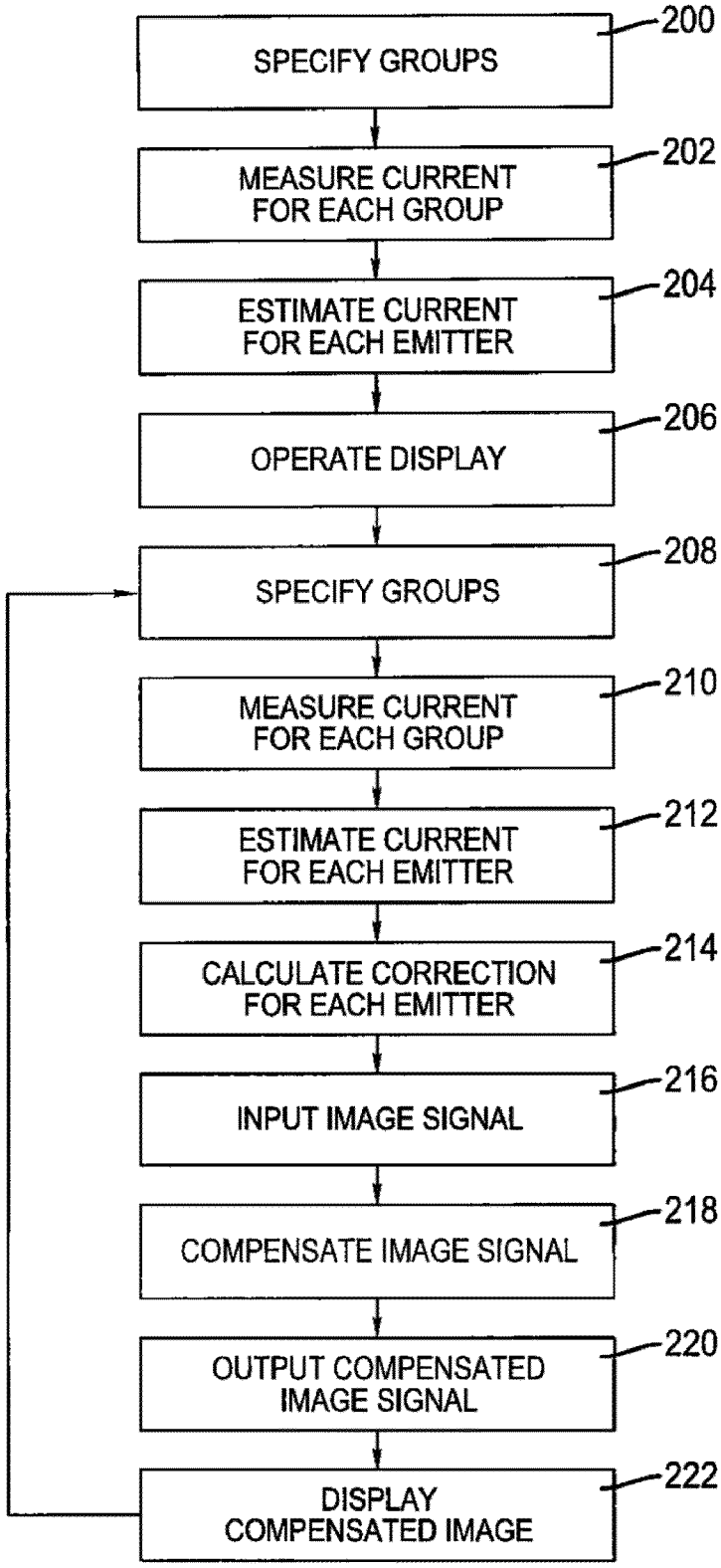

Referring to FIG. 3*a*, one embodiment of the present invention operates as follows. Before the OLED display is put into service, a measured or estimated first value of the current used by individual light-emitting elements in response to known image signals at a first time is obtained 201. Referring to FIG. 3*b*, in a specific embodiment for obtaining a measured or estimated first value of the current used by individual light-emitting elements in response to known image signals at a first time, two-or-more groups, each comprising a plurality of light-emitters in an OLED display having outputs that change with time or use, are first specified 200. The current is measured 202 for each group by providing a known image signal that stimulates only the light-emitters in a group simultaneously and then measuring the total current used by the light-emitters in the group in response to the known image signal. The measurement is repeated separately for each group until the total current used by each group is measured, typically in a sequential fashion determined to be least disruptive to a user of the OLED device. Once the current is measured 202 for each group, the current used by each light-emitting element is estimated 204. Estimates are obtained for each light-emitting element, but more than one light-emitting element may share a single estimate. The estimates may be stored, for example within the controller 16 or a memory associated with the controller, for example a non-volatile RAM.

Referring to FIGS. 3*a* and 3*b*, after obtaining a measured or estimated first value of the current used by individual light-emitting elements in response to known image signals at a first time, the OLED device is then operated 206 for a period of time chosen by lifetime expectations of the device, for example a month. After the device has been operated 206, it has aged and the light output characteristics of the light-emitting elements 12 have changed. An estimated second value of the current used by individual light-emitting elements in response to known signals at a second time is then obtained. Groups of light-emitting elements are specified 208, wherein at least one of the specified groups contains at least one light-emitting element common to another specified group, the total current for each group in response to known image signals is measured 210, and a second value of the current used by each light-emitting element at the second time is estimated 212 based on the measured total currents. By comparing the second set of current values formed at the second time with the first set of current values formed at an earlier, first time, a correction value for each light emitting element may be calculated 214. These correction values are then applied to input image signals 216 to compensate the image signal 218 for the changes in the output of the light-emitting elements due to the effects of aging. The compensated image signal is then output 220 to the display device that displays 222 the compensated image. After the device is operated for another period of time, the correction process may be repeated.

During subsequent correction value calculation cycles, the estimated current values for each light-emitting element are typically compared to the first estimates to calculate a correction value based on the changes in estimated current values since the OLED device was originally put into service. In this way, the OLED device performance may be maintained in its initial operating state. Although different groups may be employed in subsequent corrections, typically the same groups are employed each time. However, in the case that substantial changes have occurred in some areas, groups may be modified to enhance the accuracy of the estimates, for example groups may be made smaller, groups may overlap to a greater extent, or sampled groups may be employed.

As the OLED device is used and the OLED materials age, new correction values may be calculated, as often as desired. Because the measurements are done on groups of light-emitting elements, the amount of time required to take the measurements is much reduced over the time required to do a measurement separately for each light emitter. Moreover, the current measurements for groups of light-emitters are advantageously much easier to make and relatively more accurate, since the current used by a single light-emitter is very small and difficult to measure reliably while the current used by groups of light-emitters is much larger (depending on the size of the group) and less noisy. At the same time, by employing groups containing at least one common light-emitting element and by carefully combining the current measurements of each group, the correction for each light-emitter may be customized, improving the correction of image signals.

According to various embodiments of the present invention, the groups may be of different sizes, for example depending on the resolution of the OLED display, the number of light-emitters, and the time available to make the current measurements for each group. Large displays may employ larger groups, and applications in which more time is available for current measurement may employ smaller groups.

Figure 4A:
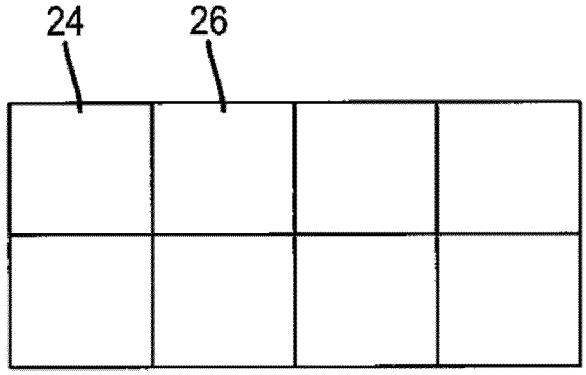
FIGS. 4*a*-4*c* are diagrams illustrating groups of light-emitting elements.
Figure 4B:
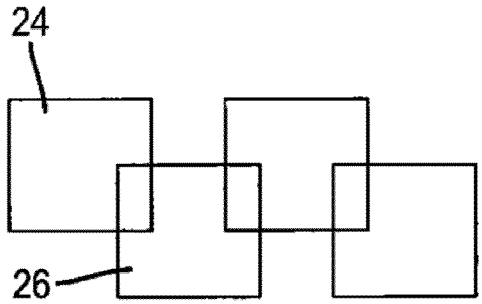
Figure 4C:
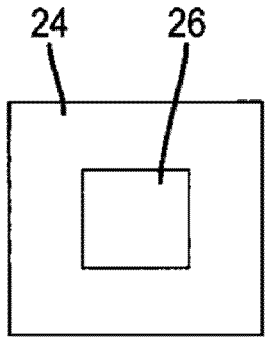

Referring to FIG. 4*a*, spatially independent groups are shown as alluded to in the prior art. As described above, in order to improve the current usage estimates for individual light-emitters, the present invention employs specified groups of light-emitting elements wherein at least one of the specified groups contains at least one light-emitting element common to another specified group. In accordance with one embodiment, the specified groups may partially overlap as shown, for example, in FIG. 4*b*. Alternatively, one group may be completely contained within another group as shown in FIG. 4*c*. The locations and sizes of the groups may differ and be defined by the resolution, size, and/or usage of the OLED display. For example, if it is known that the OLED display is intended for use in an application having graphic icons of a certain size, the groups may be defined in that size or a preferred multiple or fraction of that size.

Figure 5A:
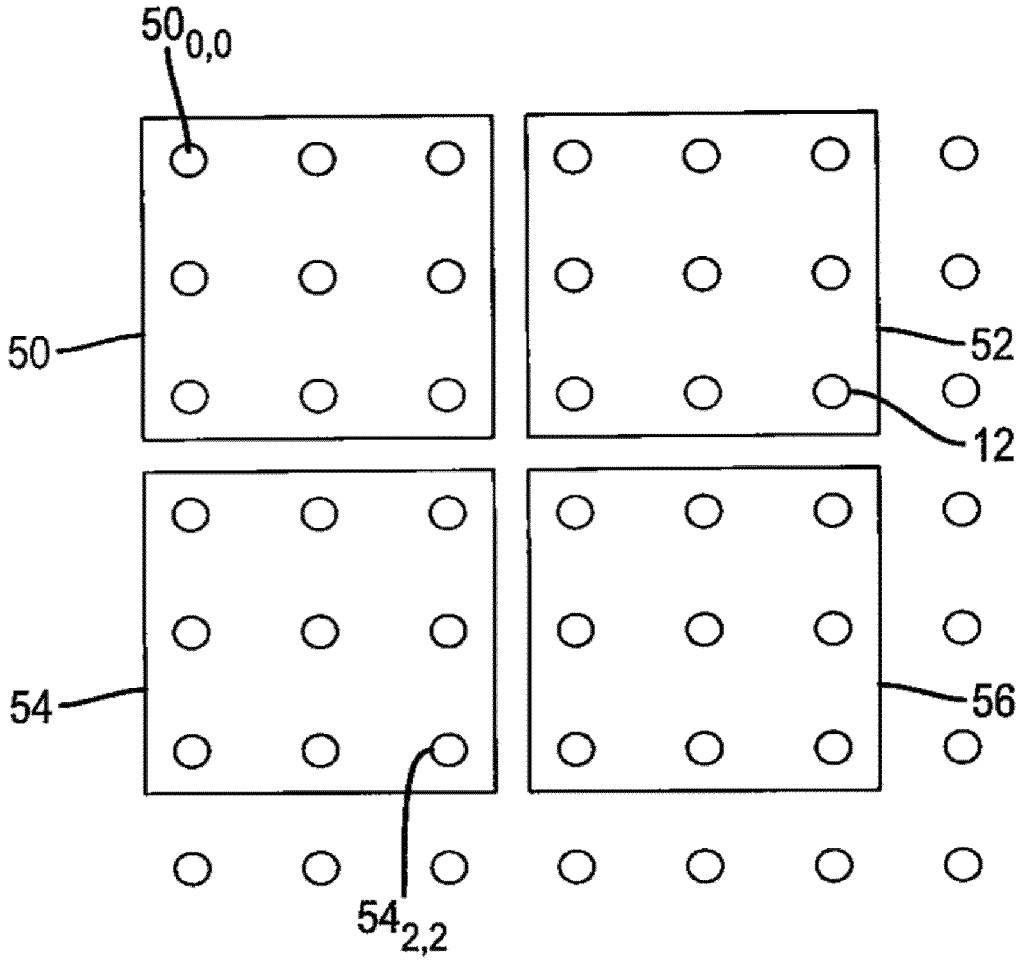
FIGS. 5*a* and 5*b* are diagrams illustrating groups of light-emitting elements.
Figure 5B:
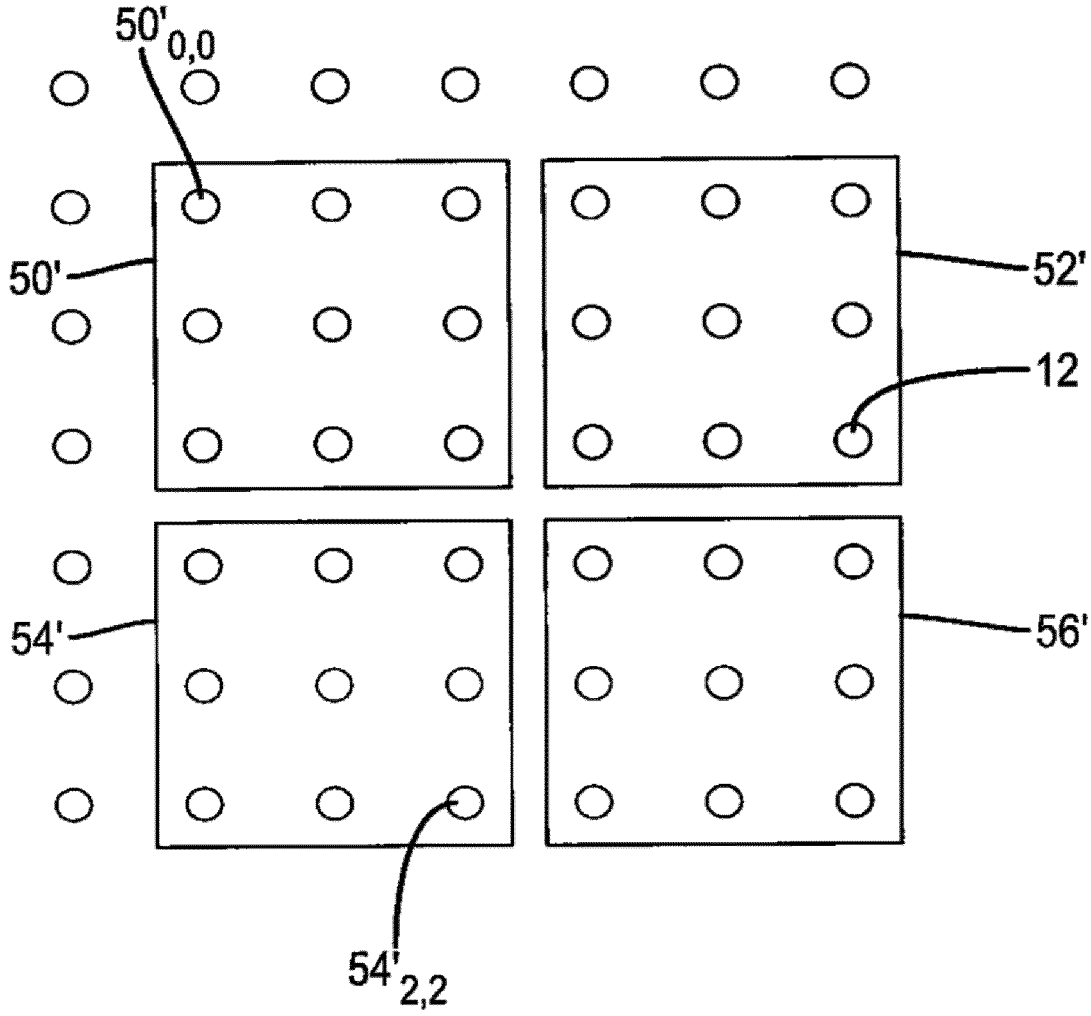

According to the present invention, the current measurements may be employed to calculate the corrections for each light-emitting element within a group. The correction obtained for each light-emitting element may be identical or, more likely, the corrections will differ. Referring to FIGS. 5*a* and 5*b*, groups of nine light-emitting elements 12 are illustrated in contiguous groups 50, 52, 54, and 56, and groups 50', 52', 54', and 56' overlapping therewith (each primed group shifted one light-emitting element to the right and down). The light-emitting elements 12 in each group are designated with a subscript corresponding to the spatial location of the light-emitting element in the group; for example the upper left light-emitting element in the group 50 is designated $\mathbf{50}_{0,0}$ and the lower right light-emitting element in the group 54 is designated $\mathbf{54}_{2,2}$.

A variety of calculation methods may be employed to estimate current usage and calculate a correction value for each light-emitting element for each of the groups. Where multiple estimates are formed for a light-emitting element common to more than one group, the estimates may be combined to form a more accurate estimate. A preferred method is to interpolate a more accurate estimate value for each light-emitting element depending on the spatial location of the light emitter within the various groups of which it is a member and the current measurement values of those groups. From an interpolated current measurement value, an interpolated correction value may be calculated. For a one dimensional example of groups containing three light emitting elements each overlapping by two elements, where a,b represents the spatial location of a group within the display containing a light-emitting element of interest, P the interpolated estimated current value of the light-emitting element of interest, and M(a,b) the current measurement of the group, the estimate for each light-emitting element may be calculated as:

$$P=(2*M(a,b)+M(a-1,b)+M(a+1,b))/4$$

This calculation may be extended into two dimensions by combining estimates for different values of b and weighting accordingly.

According to this example, the interpolated estimates for each light-emitting element in a group is equal to a weighted combination of the group measurement values, where the weighting is assigned according to the location of the light-emitting element in the group. Many alternative interpolation techniques may be employed using more group measurements and alternative weighting schemes. A great variety of interpolation calculations are known in the mathematical arts. An individual correction value may then be calculated for each light-emitting element. In a specific embodiment, where the specified groupings remain the same, each light-emitting element within a group may be presumed to consume the same current, and a common correction value for each light-emitting element of the group may be calculated by comparing the group current measurements at first and second times and estimates for the individual light-emitting elements may be interpolated from the group correction values. A variety of transformations or calculations may be employed in concert with the present invention, for example the measured or calculated data may be converted from one mathematical space (e.g. linear) to another (e.g. logarithmic), or vice versa.

Figure 6:
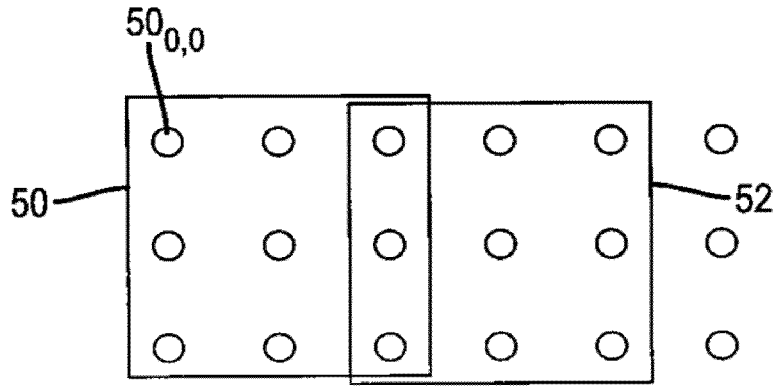
FIG. 6 is a diagram illustrating groups of light-emitting elements.

In alternative embodiments, fewer overlapping groups may be employed. For example, as shown in FIG. 6, the neighboring groups both include a common column of light-emitting elements. In this case, fewer calculations are made since fewer groups are employed. An interpolated calculation, for example, may be provided for every second light-emitting element (in the horizontal dimension). In such a case, a suitable interpolation might be:

$$P_{-}=(M(a,b)+M(a,b-1))/2$$

$$P_{+}=(M(a,b)+M(a+1,b))/2$$

where $P_+$ is the light-emitting element held in common by group (a,b) and group (a+1,b) and $P_-$ is the light-emitting element held in common by group (a,b) and group (a−1,b).

Figure 7:
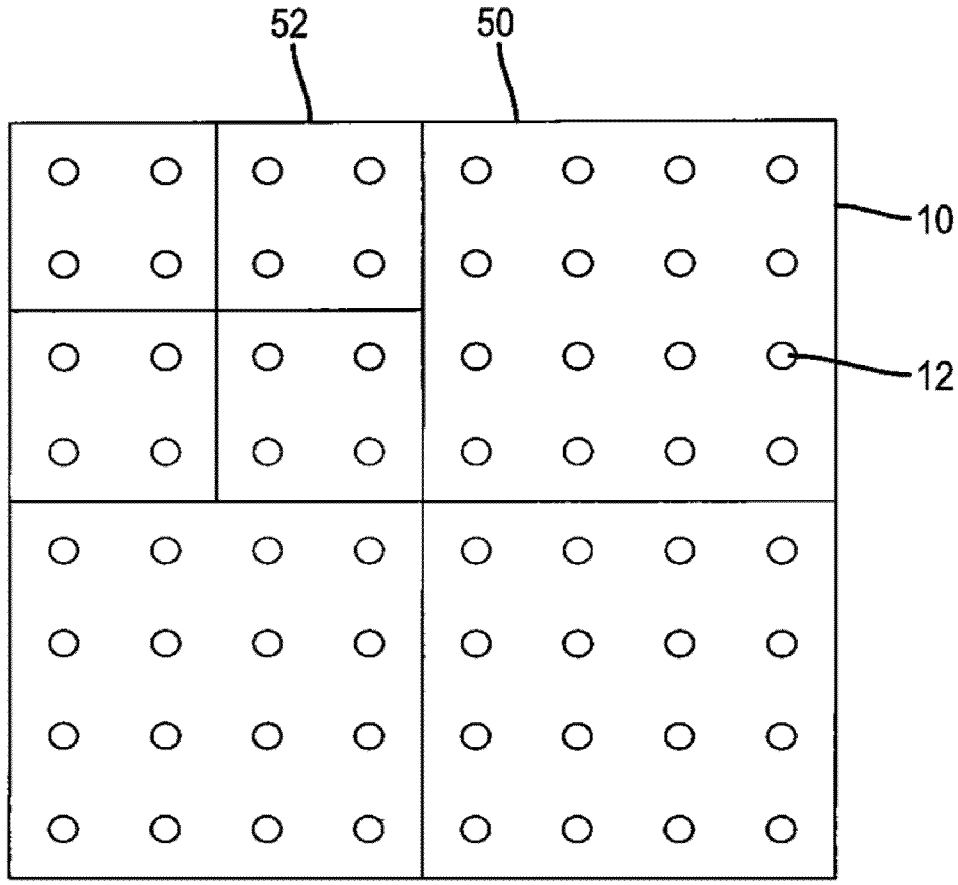
FIG. 7 is a diagram illustrating sub-divided groups of light-emitting elements.

Referring to FIG. 7, it is also possible to iteratively improve the correction in particular areas of interest. For example, a larger group size may be employed to quickly find areas that have significantly changed current measurements implying differential aging in the OLED device. Smaller groups including light-emitting elements from the larger group may then additionally be defined and current measurements taken for the smaller groups. Since the smaller groups will provide a larger number of measurements, the interpolation calculation for individual light-emitting elements may be more accurate, resulting in an improved image signal correction. This process may be repeated for increasingly smaller groups until an adequate correction for the display application is determined. The group sizes chosen may be relevant to the size of the information content representation employed on a display, for example icon size or text size. The interpolation for light-emitting elements for the smaller groups may rely on combinations of measurements for the smaller groups alone or on combinations of measurements for the larger groups and the smaller groups together. Such iterative methods may be combined with the overlapping techniques illustrated in FIGS. 5 and 6.

Figure 8:
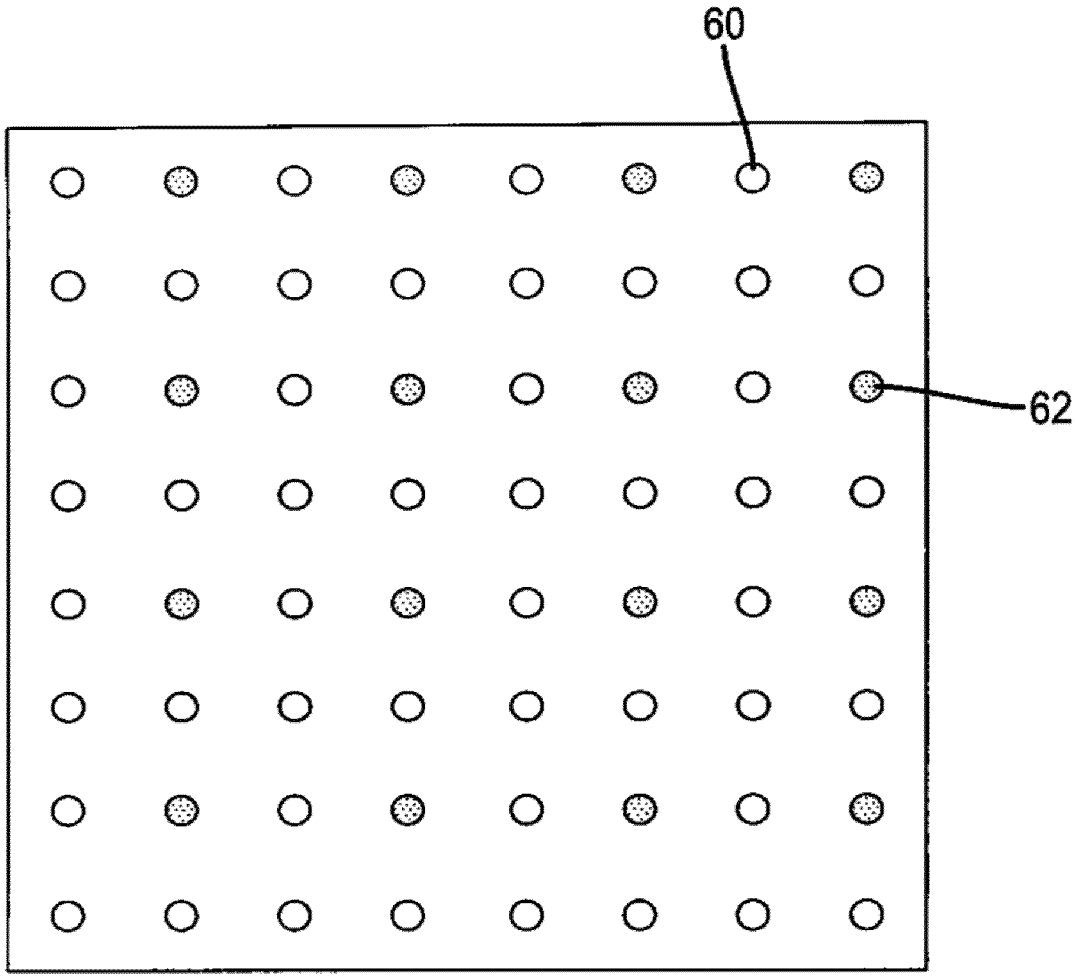
FIG. 8 is a diagram illustrating sampled groups of light-emitting elements.

In an alternative embodiment shown in FIG. 8, one or more of the groups of light-emitting elements may further comprise a sampled subset of a one- or two-dimensional array of light-emitting elements. If it is known that scene content has a particular structure, the light-emitting elements that are driven harder within that structure may be preferentially sampled. For example, if a patterned background is employed, the brighter light-emitting elements 60 in the pattern can be sampled together and the dimmer light-emitting element 62 can be sampled together to provide a better quality measure of current usage by the various light-emitting elements within the display, and hence more accurate correction values.

Over time the OLED materials will age, the resistance of the OLEDs increase, the current used at the given input image signal will decrease and the correction will increase. At some point in time, the controller circuit 16 will no longer be able to provide an image signal correction that is large enough such that the display can no longer meet its brightness or color specification, and the display will have reached the end of its optimal performance lifetime. However, the display will continue to operate as its performance declines, thus providing a graceful degradation. Moreover, the time at which the display can no longer meet its specification can be signaled to a user of the display when a maximum correction is calculated, providing useful feedback on the performance of the display.

Alternatively, the overall display brightness may be reduced to enable the correction of local defects in light output.

The present invention can be constructed simply, requiring only (in addition to a conventional display controller) a current measurement circuit, a memory, and a calculation circuit to determine the correction for the given image signal. No current accumulation or time information is necessary. Although the display may be periodically removed from use to update the measurements as the OLED device is used, the frequency of measurement may be quite low, for example months, weeks, days, or tens of hours of use. The correction value calculation process may be performed periodically during use, at power-up or power-down, when the device is powered but idle, or in response to a user signal. The measurement process may take only a few milliseconds for a group so that the effect on any user is limited. Groups may be measured at different times to further reduce the impact on any user.

Figure 2:
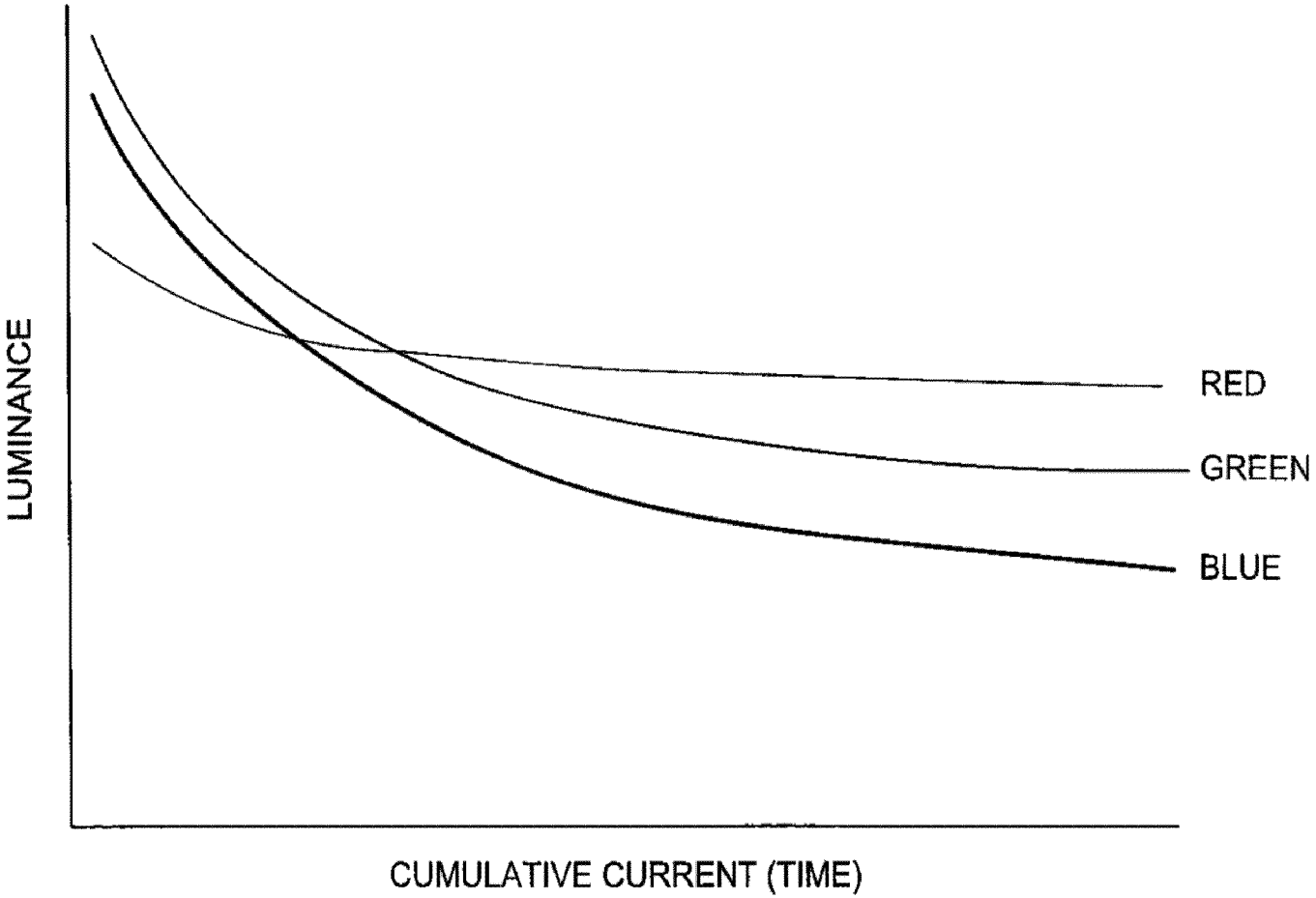
FIG. 2 is a diagram illustrating the aging of OLED display elements.

The present invention can be used to correct for changes in color of a color display. As noted in reference to FIG. 2, as current passes through the various light-emitting elements in the pixels, the materials for each color emitter will age differently. By creating groups comprising light-emitting elements of a given color, and measuring the current used by the display for that group, a correction for the light-emitting elements of the given color can be calculated separately from those of a different color.

The present invention may be extended to include complex relationships between the corrected image signal, the measured current, and the aging of the materials. Multiple image signals may be used corresponding to a variety of display outputs. For example, a different image signal may be employed for each display brightness level. When calculating the correction values, a separate correction value may be obtained for each display brightness level by using different given image signals. A separate correction signal is then employed for each display brightness level required. As noted above, this can be done for each light-emitting element group, for example different light-emitting element color groups. Hence, the correction values may correct for each display brightness level for each color as each material ages.

OLED displays dissipate significant amounts of heat and become quite hot when used over long periods of time. Further experiments by applicant have determined that there is a strong relationship between temperature and current drawn by the light-emitting elements, possibly due to voltage dependence of OLED on temperature. Therefore, if the display has been in use for a period of time, the temperature of the display may need to be taken into account in calculating the correction value. If, on the other hand, it is assumed that the display has not been in use, or if the display is cooled, it may be assumed that the display is at a pre-determined ambient temperature, for example room temperature, and the temperature of the display may not need to be taken into account in calculating the correction value. For example, mobile devices with a relatively frequent and short usage profile might not need temperature correction if the display correction value is determined at power-up. Display applications for which the display is continuously on for longer periods, for example, monitors or televisions, might require temperature accommodation, or can be corrected on power-up to avoid display temperature issues.

If the display is calibrated at power-down, the display may be significantly hotter than the ambient temperature and it is preferred to accommodate the calibration by including the temperature effect. This can be done by measuring the temperature of the display, for example with a thermocouple placed on the substrate or cover of the device, or a temperature sensing element, such as a thermistor temperature sensor 22 (see FIG. 1), integrated into the electronics of the display. Additionally, we can wait until the display temperature has reached a stable point and measure the temperature at that time. For displays that are constantly in use, the display is likely to be operated significantly above ambient temperature and the temperature can be taken into account for the display calibration. The temperature sensor 22 provides a temperature signal 17 that may be employed by the controller 16 to more accurately correct current measurements and image signals.

To further reduce the possibility of complications resulting from inaccurate current readings or inadequately compensated display temperature, changes to the correction signals applied to the input image signals may be limited by the controller, for example the correction value for a light-emitting element may be restricted to be monotonically increasing, limited to a pre-determined maximum change, calculated to maintain a constant average luminance output for the light-emitting element over its lifetime, calculated to maintain a decreasing level of luminance over the lifetime of the light-emitting element but at a rate slower than that of an uncorrected light-emitting element, and/or calculated to maintain a constant white point for the light-emitting element.

More specifically, since the aging process does not reverse, a calculated correction value might be restricted to be monotonically increasing. Any change in correction can be limited in magnitude, for example to a 5% change. Correction changes can also be averaged over time, for example an indicated correction change can be averaged with the previous value(s) to reduce variability. Alternatively, an actual correction can be made only after taking several readings, for example, every time the device is powered on, a correction calculation is performed and a number of calculated correction values (e.g. 10) are averaged to produce the actual correction value that is applied to the image signals. If a display is consistently used in a hot environment, it may be desirable to reduce the current provided to the display to compensate for increased conductivity in such an environment.

The corrected image signal may take a variety of forms depending on the OLED display device. For example, if analog voltage levels are used to specify the image signal, the correction will modify the voltages of the image signal. This can be done using amplifiers as is known in the art. In a second example, if digital values are used, for example corresponding to a charge deposited at an active-matrix light-emitting element location, a lookup table may be used to convert the digital value to another, compensated digital value as is well known in the art. In a typical OLED display device, either digital or analog video signals are used to drive the display. The actual OLED may be either voltage- or current-driven depending on the circuit used to pass current through the OLED. Again, these techniques are well known in the art.

The correction values used to modify the input image signal to form a compensated image signal may be used to control a wide variety of display performance attributes over time. For example, the model used to supply correction signals to an input image signal may hold the average luminance or white point of the display constant. Alternatively, the correction signals used to create the corrected image signal may allow the average luminance to degrade more slowly than it would otherwise due to aging or the display control signals may be selected to maintain a lower initial luminance to reduce the visibility of changes in device efficiency.

In a preferred embodiment, the invention is employed in a device that includes Organic Light-emitting Diodes (OLEDs)

which are composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light-emitting displays can be used to fabricate such a device.

General Device Architecture

The present invention can be employed in most OLED device configurations. These include very simple structures comprising a single anode and cathode to more complex devices, such as passive matrix displays comprised of orthogonal arrays of anodes and cathodes to form light-emitting elements, and active-matrix displays where each light-emitting element is controlled independently, for example, with thin film transistors (TFTs).

Figure 9:
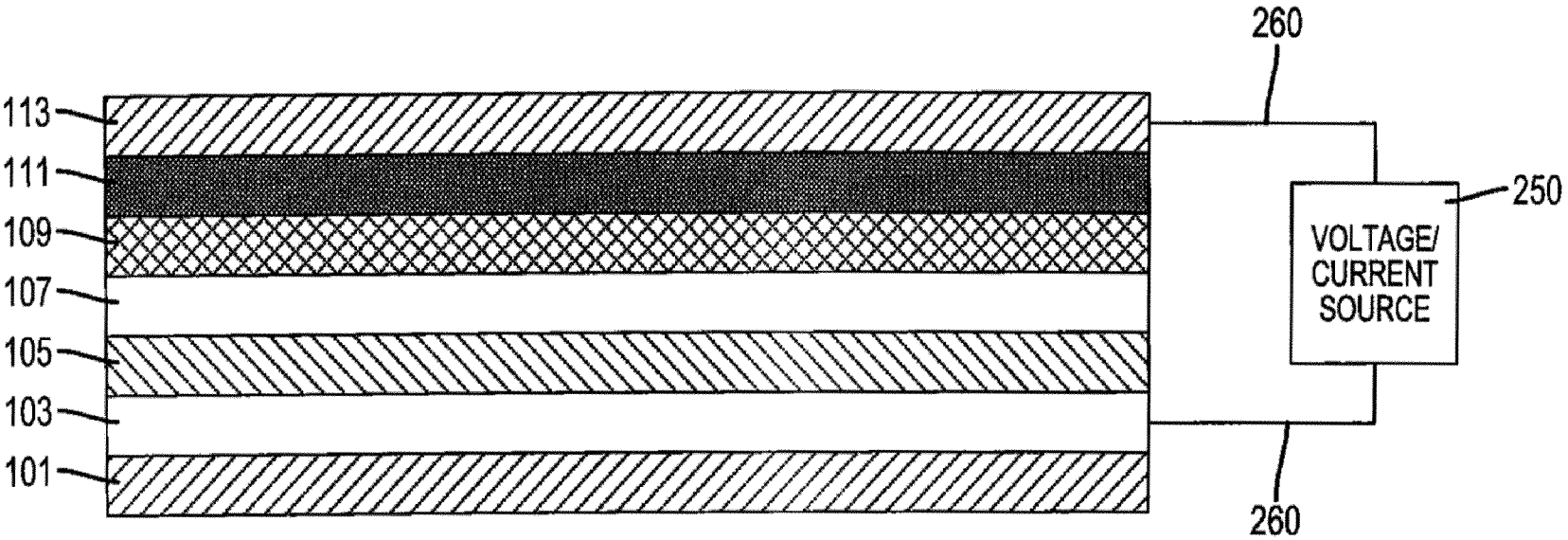
FIG. 9 (PRIOR ART)
FIG. 9 is a partial cross-section illustrating a prior-art OLED device.

There are numerous configurations of the organic layers wherein the present invention can be successfully practiced. A typical prior art structure is shown in FIG. 9 and is comprised of a substrate 101, an anode 103, a hole-injecting layer 105, a hole-transporting layer 107, a light-emitting layer 109, an electron-transporting layer 111, and a cathode 113. These layers are described in detail below. Note that the substrate may alternatively be located adjacent to the cathode, or the substrate may actually constitute the anode or cathode. The organic layers between the anode and cathode are conveniently referred to as the organic EL element. The total combined thickness of the organic layers is preferably less than 500 nm.

The anode and cathode of the OLED are connected to a voltage/current source 250 through electrical conductors 260. The OLED is operated by applying a potential between the anode and cathode such that the anode is at a more positive potential than the cathode. Holes are injected into the organic EL element from the anode and electrons are injected into the organic EL element at the anode. Enhanced device stability can sometimes be achieved when the OLED is operated in an AC mode where, for some time period in the cycle, the potential bias is reversed and no current flows. An example of an AC-driven OLED is described in U.S. Pat. No. 5,552,678.

Substrate

The OLED device of this invention is typically provided over a supporting substrate where either the cathode or anode can be in contact with the substrate. The electrode in contact with the substrate is conveniently referred to as the bottom electrode. Conventionally, the bottom electrode is the anode, but this invention is not limited to that configuration. The substrate can either be transmissive or opaque. In the case wherein the substrate is transmissive, a reflective or light absorbing layer is used to reflect the light through the cover or to absorb the light, thereby improving the contrast of the display. Substrates can include, but are not limited to, glass, plastic, semiconductor materials, silicon, ceramics, and circuit board materials. Of course it is necessary to provide a light-transparent top electrode.

Anode

When EL emission is viewed through anode 103, the anode should be transparent or substantially transparent to the emission of interest. Common transparent anode materials used in this invention are indium-tin oxide (ITO), indium-zinc oxide (IZO) and tin oxide, but other metal oxides can work including, but not limited to, aluminum- or indium-doped zinc oxide, magnesium-indium oxide, and nickel-tungsten oxide. In addition to these oxides, metal nitrides, such as gallium nitride, and metal selenides, such as zinc selenide, and metal sulfides, such as zinc sulfide, can be used as the anode. For applications where. EL emission is viewed only through the cathode electrode, the transmissive characteristics of anode are immaterial and any conductive material can be used, transparent, opaque or reflective. Example conductors for this application include, but are not limited to, gold, iridium, molybdenum, palladium, and platinum. Typical anode materials, transmissive or otherwise, have a work function of 4.1 eV or greater. Desired anode materials are commonly deposited by any suitable means such as evaporation, sputtering, chemical vapor deposition, or electrochemical means. Anodes can be patterned using well-known photolithographic processes. Optionally, anodes may be polished prior to application of other layers to reduce surface roughness so as to minimize shorts or enhance reflectivity.

Hole-Injecting Layer (HIL)

While not always necessary, it is often useful to provide a hole-injecting layer 105 between anode 103 and hole-transporting layer 107. The hole-injecting material can serve to improve the film formation property of subsequent organic layers and to facilitate injection of holes into the hole-transporting layer. Suitable materials for use in the hole-injecting layer include, but are not limited to, porphyrinic compounds as described in U.S. Pat. No. 4,720,432, plasma-deposited fluorocarbon polymers as described in U.S. Pat. No. 6,208,075, and some aromatic amines, for example, m-MTDATA (4,4',4"-tris[(3-methylphenyl)phenylamino]triphenylamine). Alternative hole-injecting materials reportedly useful in organic EL devices are described in EP 0 891 121 A1 and EP 1 029 909 A1.

Hole-Transporting Layer (HTL)

The hole-transporting layer 107 contains at least one hole-transporting compound such as an aromatic tertiary amine, where the latter is understood to be a compound containing at least one trivalent nitrogen atom that is bonded only to carbon atoms, at least one of which is a member of an aromatic ring. In one form the aromatic tertiary amine can be an arylamine, such as a monoarylamine, diarylamine, triarylamine, or a polymeric arylamine. Exemplary monomeric triarylamines are illustrated by Klupfel et al. U.S. Pat. No. 3,180,730. Other suitable triarylamines substituted with one or more vinyl radicals and/or comprising at least one active hydrogen containing group are disclosed by Brantley et al U.S. Pat. Nos. 3,567,450 and 3,658,520.

A more preferred class of aromatic tertiary amines are those which include at least two aromatic tertiary amine moieties as described in U.S. Pat. Nos. 4,720,432 and 5,061,569. The hole-transporting layer can be formed of a single or a mixture of aromatic tertiary amine compounds. Illustrative of useful aromatic tertiary amines are the following:

1,1-Bis(4-di-p-tolylaminophenyl)cyclohexane
1,1-Bis(4-di-p-tolylaminophenyl)-4-phenylcyclohexane
4,4'-Bis(diphenylamino)quadriphenyl
Bis(4-dimethylamino-2-methylphenyl)-phenylmethane
N,N,N-Tri(p-tolyl)amine
4-(di-p-tolylamino)-4'-[4(di-p-tolylamino)-styryl]stilbene
N,N,N',N'-Tetra-p-tolyl-4-4'-diaminobiphenyl
N,N,N',N'-Tetraphenyl-4,4'-diaminobiphenyl
N,N,N',N'-tetra-1-naphthyl-4,4'-diaminobiphenyl
N,N,N',N'-tetra-2-naphthyl-4,4'-diaminobiphenyl
N-Phenylcarbazole
4,4'-Bis[N-(1-naphthyl)-N-phenylamino]biphenyl
4,4'-Bis[N-(1-naphthyl)-N-(2-naphthyl)amino]biphenyl
4,4"-Bis[N-(1-naphthyl)-N-phenylamino]p-terphenyl
4,4'-Bis[N-(2-naphthyl)-N-phenylamino]biphenyl
4,4'-Bis[N-(3-acenaphthenyl)-N-phenylamino]biphenyl
1,5-Bis[N-(1-naphthyl)-N-phenylamino]naphthalene
4,4-Bis[N-(9-anthryl)-N-phenylamino]biphenyl
4,4"-Bis[N-(1-anthryl)-N-phenylamino]-p-terphenyl
4,4-Bis[N-(2-phenanthryl)-N-phenylamino]biphenyl 4,4'-Bis[N-(8-fluoranthenyl)-N-phenylamino]biphenyl
4,4'-Bis[N-(2-pyrenyl)-N-phenylamino]biphenyl
4,4'-Bis[N-(2-naphthacenyl)-N-phenylamino]biphenyl
4,4'-Bis[N-(2-perylenyl)-N-phenylamino]biphenyl
4,4'-Bis[N-(1-coronenyl)-N-phenylamino]biphenyl
2,6-Bis(di-p-tolylamino)naphthalene
2,6-Bis[di-(1-naphthyl)amino]naphthalene
2,6-Bis[N-(1-naphthyl)-N-(2-naphthyl)amino]naphthalene
N,N,N',N'-Tetra(2-naphthyl)-4,4"-diamino-p-terphenyl
4,4'-Bis{N-phenyl-N-[4-(1-naphthyl)-phenyl]amino}biphenyl
4,4'-Bis[N-phenyl-N-(2-pyrenyl)amino]biphenyl
2,6-Bis[N,N-di(2-naphthyl)amine]fluorene
1,5-Bis[N-(1-naphthyl)-N-phenylamino]naphthalene
4,4',4"-tris[(3-methylphenyl)phenylamino]triphenylamine Another class of useful hole-transporting materials includes polycyclic aromatic compounds as described in EP 1 009 041. Tertiary aromatic amines with more than two amine groups may be used including oligomeric materials. In addition, polymeric hole-transporting materials can be used such as poly(N-vinylcarbazole) (PVK), polythiophenes, polypyrrole, polyaniline, and copolymers such as poly(3,4-ethylenedioxythiophene)/poly(4-styrenesulfonate) also called PEDOT/PSS.

Light-Emitting Layer (LEL)

As more fully described in U.S. Pat. Nos. 4,769,292 and 5,935,721, the light-emitting layer (LEL) 109 of the organic EL element includes a luminescent or fluorescent material where electroluminescence is produced as a result of electron-hole pair recombination in this region. The light-emitting layer can be comprised of a single material, but more commonly consists of a host material doped with a guest compound or compounds where light emission comes primarily from the dopant and can be of any color. The host materials in the light-emitting layer can be an electron-transporting material, as defined below, a hole-transporting material, as defined above, or another material or combination of materials that support hole-electron recombination. The dopant is usually chosen from highly fluorescent dyes, but phosphorescent compounds, e.g., transition metal complexes as described in WO 98/55561, WO 00/18851, WO 00/57676, and WO 00/70655 are also useful. Dopants are typically coated as 0.01 to 10% by weight into the host material. Polymeric materials such as polyfluorenes and polyvinylarylenes (e.g., poly(p-phenylenevinylene), PPV) can also be used as the host material. In this case, small molecule dopants can be molecularly dispersed into the polymeric host, or the dopant could be added by copolymerizing a minor constituent into the host polymer.

An important relationship for choosing a dye as a dopant is a comparison of the bandgap potential which is defined as the energy difference between the highest occupied molecular orbital and the lowest unoccupied molecular orbital of the molecule. For efficient energy transfer from the host to the dopant molecule, a necessary condition is that the band gap of the dopant is smaller than that of the host material. For phosphorescent emitters it is also important that the host triplet energy level of the host be high enough to enable energy transfer from host to dopant.

Host and emitting molecules known to be of use include, but are not limited to, those disclosed in U.S. Pat. Nos. 4,768,292; 5,141,671; 5,150,006; 5,151,629; 5,405,709; 5,484,922; 5,593,788; 5,645,948; 5,683,823; 5,755,999; 5,928,802; 5,935,720; 5,935,721; and 6,020,078.

Metal complexes of 8-hydroxyquinoline (oxine) and similar derivatives constitute one class of useful host compounds capable of supporting electroluminescence illustrative of useful chelated oxinoid compounds are the following:

CO-1: Aluminum trisoxine [alias, tris(8-quinolinolato)aluminum(III)]
CO-2: Magnesium bisoxine [alias, bis(8-quinolinolato) magnesium(II)]
CO-3: Bis[benzo{f}-8-quinolinolato]zinc (II)
CO-4: Bis(2-methyl-8-quinolinolato)aluminum(III)-O-oxo-bis(2-methyl-8-quinolinolato)aluminum(III)
CO-5: Indium trisoxine [alias, tris(8-quinolinolato)indium]
CO-6: Aluminum tris(5-methyloxine) [alias, tris(5-methyl-8-quinolinolato)aluminum(III)]
CO-7: Lithium oxine [alias, (8-quinolinolato)lithium(I)]
CO-8: Gallium oxine [alias, tris(8-quinolinolato)gallium (III)]
CO-9: Zirconium oxine [alias, tetra(8-quinolinolato)zirconium(IV)]

Other classes of useful host materials include, but are not limited to: derivatives of anthracene, such as 9,10-di-(2-naphthyl)anthracene and derivatives thereof as described in U.S. Pat. No. 5,935,721, distyrylarylene derivatives as described in U.S. Pat. No. 5,121,029, and benzazole derivatives, for example, 2,2',2"-(1,3,5-phenylene)tris[1-phenyl-1H-benzimidazole]. Carbazole derivatives are particularly useful hosts for phosphorescent emitters.

Useful fluorescent dopants include, but are not limited to, derivatives of anthracene, tetracene, xanthene, perylene, rubrene, coumarin, rhodamine, and quinacridone, dicyanomethylenepyran compounds, thiopyran compounds, polymethine compounds, pyrilium and thiapyrilium compounds, fluorene derivatives, periflanthene derivatives, indenoperylene derivatives, bis(azinyl)amine boron compounds, bis(azinyl)methane compounds, and carbostyryl compounds.

Electron-Transporting Layer (ETL)

Preferred thin film-forming materials for use in forming the electron-transporting layer 111 of the organic EL elements of this invention are metal chelated oxinoid compounds, including chelates of oxine itself (also commonly referred to as 8-quinolinol or 8-hydroxyquinoline). Such compounds help to inject and transport electrons, exhibit high levels of performance, and are readily fabricated in the form of thin films. Exemplary oxinoid compounds were listed previously.

Other electron-transporting materials include various butadiene derivatives as disclosed in U.S. Pat. No. 4,356,429 and various heterocyclic optical brighteners as described in U.S. Pat. No. 4,539,507. Benzazoles and triazines are also useful electron-transporting materials.

Cathode

When light emission is viewed solely through the anode, the cathode 113 used in this invention can be comprised of nearly any conductive material. Desirable materials have good film-forming properties to ensure good contact with the underlying organic layer, promote electron injection at low voltage, and have good stability. Useful cathode materials often contain a low work function metal (<4.0 eV) or metal alloy. One preferred cathode material is comprised of a Mg:Ag alloy wherein the percentage of silver is in the range of 1 to 20%, as described in U.S. Pat. No. 4,885,221. Another suitable class of cathode materials includes bilayers comprising a thin electron-injection layer (EIL) in contact with the organic layer (e.g., ETL) which is capped with a thicker layer of a conductive metal. Here, the EIL preferably includes a low work function metal or metal salt, and if so, the thicker capping layer does not need to have a low work function. One such cathode is comprised of a thin layer of LiF followed by a thicker layer of Al as described in U.S. Pat. No. 5,677,572. Other useful cathode material sets include, but are not limited to, those disclosed in U.S. Pat. Nos. 5,059,861, 5,059,862, and 6,140,763.

When light emission is viewed through the cathode, the cathode must be transparent or nearly transparent. For such applications, metals must be thin or one must use transparent conductive oxides, or a combination of these materials. Optically transparent cathodes have been described in more detail in U.S. Pat. Nos. 4,885,211, 5,247,190, JP 3,234,963, U.S. Pat. Nos. 5,703,436, 5,608,287, 5,837,391, 5,677,572, 5,776,622, 5,776,623, 5,714,838, 5,969,474, 5,739,545, 5,981,306, 6,137,223, 6,140,763, 6,172,459, EP 1 076 368, U.S. Pat. Nos. 6,278,236, and 6,284,393. Cathode materials are typically deposited by evaporation, sputtering, or chemical vapor deposition.

When needed, patterning can be achieved through many well known methods including, but not limited to, through-mask deposition, integral shadow masking, for example, as described in U.S. Pat. No. 5,276,380 and EP 0 732 868, laser ablation, and selective chemical vapor deposition.

Other Common Organic Layers and Device Architecture

In some instances, layers 109 and 111 can optionally be collapsed 30 into a single layer that serves the function of supporting both light emission and electron transportation. It also known in the art that emitting dopants may be added to the hole-transporting layer, which may serve as a host. Multiple dopants may be added to one or more layers in order to create a white-emitting OLED, for example, by combining blue- and yellow-emitting materials, cyan- and red-emitting materials, or red-, green-, and blue-emitting materials. White-emitting devices are described, for example, in EP 1 187 235, US 20020025419, EP 1 182 244, U.S. Pat. Nos. 5,683,823, 5,503,910, 5,405,709, and U.S. Pat. No. 5,283,182.

Additional layers such as electron or hole-blocking layers as taught in the art may be employed in devices of this invention. Hole-blocking layers are commonly used to improve efficiency of phosphorescent emitter devices, for example, as in US 20020015859.

This invention may be used in so-called stacked device architecture, for example, as taught in U.S. Pat. Nos. 5,703,436 and 6,337,492.

Deposition of Organic Layers

The organic materials mentioned above are suitably deposited through a vapor-phase method such as sublimation, but can be deposited from a fluid, for example, from a solvent with an optional binder to improve film formation. If the material is a polymer, solvent deposition is useful but other methods can be used, such as sputtering or thermal transfer from a donor sheet. The material to be deposited by sublimation can be vaporized from a sublimator "boat" often comprised of a tantalum material, e.g., as described in U.S. Pat. No. 6,237,529, or can be first coated onto a donor sheet and then sublimed in closer proximity to the substrate. Layers with a mixture of materials can utilize separate sublimator boats or the materials can be pre-mixed and coated from a single boat or donor sheet. Patterned deposition can be achieved using shadow masks, integral shadow masks (U.S. Pat. No. 5,294,870), spatially-defined thermal dye transfer from a donor sheet (U.S. Pat. Nos. 5,688,551, 5,851,709 and 6,066,357) and inkjet method (U.S. Pat. No. 6,066,357).

Encapsulation

Most OLED devices are sensitive to moisture or oxygen, or both, so they are commonly sealed in an inert atmosphere such as nitrogen or argon, along with a desiccant such as alumina, bauxite, calcium sulfate, clays, silica gel, zeolites, alkaline metal oxides, alkaline earth metal oxides, sulfates, or metal halides and perchlorates. Methods for encapsulation and desiccation include, but are not limited to, those described in U.S. Pat. No. 6,226,890. In addition, barrier layers such as SiOx, Teflon, and alternating inorganic/polymeric layers are known in the art for encapsulation.

Optical Optimization

OLED devices of this invention can employ various well-known optical effects in order to enhance its properties if desired. This includes optimizing layer thicknesses to yield maximum light transmission, providing dielectric mirror structures, replacing reflective electrodes with light-absorbing electrodes, providing anti glare or anti-reflection coatings over the display, providing a polarizing medium over the display, or providing colored, neutral density, or color conversion filters over the display. Filters, polarizers, and anti-glare or anti-reflection coatings may be specifically provided over the cover or an electrode protection layer beneath the cover.

The invention has been described in detail with particular reference to certain preferred embodiments thereof, but it will be understood that variations and modifications can be effected within the spirit and scope of the invention.

Parts List

10 OLED display
12 light-emitting elements
13 current signal
14 current measuring device
16 controller
17 temperature signal
18 input image signal
20 corrected input image signal
22 temperature measuring device
24 group of light-emitting elements
26 group of light-emitting elements
50 group of light-emitting elements
50' group of light-emitting elements
$\mathbf{50}_{0,0}$ light-emitting element
$\mathbf{50'}_{0,0}$ light-emitting element
52 group of light-emitting elements
52' group of light-emitting elements
54 group of light-emitting elements
54' group of light-emitting elements
$\mathbf{54}_{2,2}$ light-emitting element
$\mathbf{54'}_{2,2}$ light-emitting element
56 group of light-emitting elements
56' group of light-emitting elements
60 bright pixel
62 dim pixel
101 substrate
103 anode
105 hole injecting layer
107 hole transporting layer
109 light-emitting layer
111 electron-transporting layer
113 cathode
200 specify groups step
201 obtain current step
202 measure current step
204 estimate current step
206 operate display step
208 specify groups step
210 measure current step
212 estimate current step

214 calculate correction step
216 input image step
218 compensate image step
220 output compensated image step
222 display compensated image step
250 voltage/current source
260 electrical conductors

What is claimed is:

1. A method of compensating image signals for driving an OLED display having a plurality of light-emitting elements having outputs that change with time or use, the method comprising:

obtaining an initial measured or estimated first current value used by each of the respective light-emitting elements in response to known image signals at a first time before the OLED display is put into service;

specifying multiple groups of light-emitting elements at a second time later than the first time;

measuring total currents used by each of the specified groups in response to known image signals at the second time;

comparing the measured total current used by each of the specified groups at the second time to the same specified group's total first current values to determine at least one specified group whose measured total current is sufficiently different from the same specified group's total first current values;

specifying multiple smaller groups of individual light-emitting elements that are subsets of the determined specified group;

measuring total currents used by each of the specified smaller groups in response to known image signals at the second time;

comparing the measured total current used by each of the specified smaller groups to the same specified smaller group's total first current values to determine at least one specified smaller group whose measured total current is sufficiently different from the same specified smaller group's total first current values;

forming an estimated second value of the current used by individual light-emitting elements within the determined smaller groups based on the measured total currents of the smaller groups;

calculating correction values for individual light-emitting elements within the determined smaller groups based on the difference between the first and second current values; and employing the correction values to compensate image signals for the changes in the output of the light-emitting elements and produce compensated image signals.

2. The method of claim 1, wherein at least two of the specified groups are of different sizes.

3. The method of claim 1, wherein each of the specified groups overlaps with another of the specified groups.

4. The method of claim 1, wherein the correction values are the same for each light-emitting element within at least one of the determined specified smaller groups.

5. The method of claim 1, wherein the correction values are different for at least two light-emitting elements within at least one of the determined specified smaller groups.

6. The method of claim 1, wherein the estimated second value of the current used by at least one individual light-emitting element of the specified smaller group is interpolated from the measured total currents.

7. The method of claim 6, wherein the interpolation is dependent on the location of the at least one light-emitting element within a specified group.

8. The method of claim 1, further comprising:

iteratively specifying sub-groups within a specified smaller group; and measuring the total current used by at least one of the sub-groups.

9. The method of claim 8, further comprising forming an estimate of the current used by individual light-emitting elements in the at least one sub-group, based on the measured total current of the sub-group.

10. The method claimed in claim 1, wherein the total currents used by the specified groups are measured in response to a plurality of different known image signals to calculate a plurality of correction values for different image signals.

11. The method claimed in claim 1, wherein total currents used by the specified groups at the second time are measured at power-up, power-down, when the device is powered but idle, in response to a user signal, or periodically.

12. The method claimed in claim 1, wherein:

the method is repeated over time to obtain recalculated correction values; and the correction value for a light-emitting element is restricted to be monotonically increasing, limited to a predetermined maximum change, calculated to maintain a constant average luminance output for the light-emitting element over its lifetime, calculated to maintain a decreasing level of luminance over the lifetime of the light-emitting element but at a rate slower than that of an uncorrected light-emitting element, and/or calculated to maintain a constant white point for the light-emitting element.

13. The method claimed in claim 1, wherein:

the output of the light-emitting elements changes with temperature; and the method further comprises:

sensing the temperature of the display; and using the temperature in calculating the correction values.

14. The method claimed in claim 1, wherein the display is a color display including an array of pixels, each pixel comprising a plurality of differently colored light -emitting elements.

15. The method of claim 1, wherein the locations of the groups are defined by the usage of the OLED display.

16. The method of claim 1, wherein one or more of the specified groups comprises a sampled subset of a one- or two-dimensional array of light-emitting elements.

17. The method of claim 1, wherein:

the measured or estimated first current value used by respective light-emitting elements is obtained by:

specifying first multiple groups of light-emitting elements at a first time;

measuring first total currents used by each of the first groups in response to known image signals at the first time; and forming a first estimated current value used by respective light-emitting elements based on the measured first total current.

18. An OLED display comprising a controller for using the method of claim 1.

19. The OLED display claimed in claim 18, wherein:

the output of the light-emitting elements changes with temperature;

the OLED display further comprises a temperature sensor; and the controller is also responsive to the temperature to calculate the correction values.

* * * * *